United States Patent [19]

Byrnes, Sr. et al.

[11] 4,384,449

[45] May 24, 1983

[54] PROTECTIVE GLOVES AND THE LIKE AND A YARN WITH FLEXIBLE CORE WRAPPED WITH ARAMID FIBER

[75] Inventors: Robert M. Byrnes, Sr.; A. J. Haas, Jr., both of Omaha, Nebr.

[73] Assignee: Robert M. Byrnes, Sr., Omaha, Nebr.

[21] Appl. No.: 99,092

[22] Filed: Nov. 30, 1979

Related U.S. Application Data

[63] Continuation of Ser. No. 730,275, Oct. 5, 1976, abandoned.

[51] Int. Cl.[3] ..... D02G 3/12; A41D 19/00; D02G 3/36

[52] U.S. Cl. ..... 57/210; 2/161 R; 2/167; 57/211; 57/230; 57/902; 139/425 R

[58] Field of Search ..... 57/210, 211, 235, 230, 57/901, 902; 2/161, 167; 139/425 R

[56] References Cited

U.S. PATENT DOCUMENTS

| | | | |
|---|---|---|---|
| 831,108 | 9/1906 | Ryder | 57/210 |
| 3,019,592 | 2/1962 | Gould et al. | 57/235 |
| 3,277,564 | 10/1966 | Webber et al. | 57/901 X |
| 3,288,175 | 11/1966 | Valko | 57/901 X |
| 3,315,456 | 4/1967 | Freydberg | 57/235 |
| 3,490,224 | 1/1970 | Bourgeas | 57/210 |
| 3,699,590 | 10/1972 | Webber et al. | 57/901 X |
| 4,004,295 | 1/1977 | Byrnes, Sr. | 2/167 X |

FOREIGN PATENT DOCUMENTS

| | | | |
|---|---|---|---|
| 1610495 | 9/1967 | Fed. Rep. of Germany . | |
| 2120418 | 11/1972 | Fed. Rep. of Germany . | |
| 1514826 | 1/1968 | France . | |
| 1539816 | 8/1968 | France . | |
| 40-24091 | 8/1965 | Japan . | |
| 43-5157 | 3/1968 | Japan . | |
| 47-28125 | 4/1972 | Japan . | |
| 50-121089 | 9/1975 | Japan . | |
| 290677 | 3/1963 | Netherlands . | |
| 187327 | 10/1922 | United Kingdom | 139/425 R |

OTHER PUBLICATIONS

Webber; "Metal Fibers", Modern Textiles Magazine, May, 1966, pp. 72–75.

Barry; "Textile Applications of Metal Fibers", Modern Textiles Magazine, pp. 53–56, Jun. 1967.

Allen; "Textile Applications for Fine Metallic Filaments", Modern Textiles, pp. 60–61, Mar. 1974.

*Primary Examiner*—John Petrakes

*Attorney, Agent, or Firm*—Harvey B. Jacobson

[57] ABSTRACT

Protective gloves and the like and a yarn comprising a core of a flexible wire alongside an aramid fiber strand or strands and a covering of aramid fiber such as that manufactured and sold under the trademark "Kevlar" by the DuPont Company of Wilmington, Del. in which the aramid fiber is either spun or filament. Two aramid fiber strands, either spun or filament, are wrapped around the core with one strand wrapped in a clockwise direction and the other strand wrapped in a counterclockwise direction with the opposite spiral wrapping of the strands serving to secure the strands in position on the core without any other securing means. The yarn having a flexible core with aramid fiber strands wrapped thereon is used to make protective gloves on conventional glove knitting or weaving machinery and is capable of movement in relation to needle eyes and the like without jamming in the same manner as various natural and synthetic fiber yarns. The yarn having a flexible core with aramid fiber strands wrapped thereon is also used in making various other products normally made of conventional fiber yarn.

31 Claims, 2 Drawing Figures

PROTECTIVE GLOVES AND THE LIKE AND A YARN WITH FLEXIBLE CORE WRAPPED WITH ARAMID FIBER

This is a continuation, of application Ser. No. 730,275, filed Oct. 5, 1976, now abandoned.

BACKGROUND OF THE INVENTION

1. Field of the Invention

The present invention generally relates to protective gloves and the like and a yarn which includes a metallic, totally annealed flexible wire strand or strands and an aramid fiber strand or strands, either spun or filament, as a core wrapped with two strands or fibers of a spun or filament aramid fiber capable of being used in conventional glove making machinery or other machinery employed to make various garments, fabrics and the like by standard weaving, knitting or other techniques of associating yarns. A preferred aramid fiber for the present invention, either spun or filament, is that marketed by E. I. DuPont of Wilmington, Del., under the trademark "Kevlar".

2. Description of the Prior Art

In prior U.S. Pat. No. 3,883,898 issued May 20, 1975, the use of aramid fiber, such as "Kevlar", in making protective gloves, garments and the like is disclosed. Prior U.S. Pat. No. 3,953,893 issued May 4, 1976 relates to a protective apron constructed from this material.

Prior co-pending application Ser. No. 645,477, filed Dec. 30, 1975 for Protective Glove Constructed of Flexible Strands of Metal Wire and Fiber Yarn, now U.S. Pat. No. 4,004,295, issued Jan. 25, 1977, discloses broadly the combination of flexible metal wire strands and flexible aramid fiber yarn strands, such as "Kevlar", in the construction of woven, non-woven or knitted gloves from these materials. While the "Kevlar" material by itself or used in combination with flexible wire strands is successful for many applications, an improved yarn and fabric are desirable for certain usages.

SUMMARY OF THE INVENTION

An object of the present invention is to provide protective gloves or the like constructed from a yarn having a flexible core wrapped with aramid fiber.

Another object of the invention is to provide a glove in accordance with the preceding object in which the core includes a strand or strands of flexible, annealed wire and a strand or strands of aramid fiber, either spun or filament, alongside the wire and the fiber wrapping is in the form of two relatively fine strands, either spun or filament, wound in opposite directions around the core.

A further important object of the present invention is to provide a yarn having a flexible core wrapped with aramid fiber for use in making protective gloves and other items.

Another object of the invention is to provide a yarn in accordance with the preceding object in which the aramid fiber wrapping, such as "Kevlar", is in the form of two strands of a relatively fine spun strand in which one strand is wound in a clockwise direction and the other strand is wound in a counterclockwise direction on the flexible core.

A further object of the invention is to provide a yarn in accordance with the preceding objects in which the core includes a strand or strands of flexible, annealed wire and a strand or strands of aramid fiber, either spun or filament, alongside of the wire.

Still another object of the invention is to provide a yarn in accordance with the preceding objects in which the flexibility of the yarn as well as the dimensional characteristics and other physical characteristics thereof are maintained within limits enabling the yarn to be utilized in standard yarn handling and processing machinery such as glove forming machinery or machinery for forming various fabrics and garments as well as other items.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
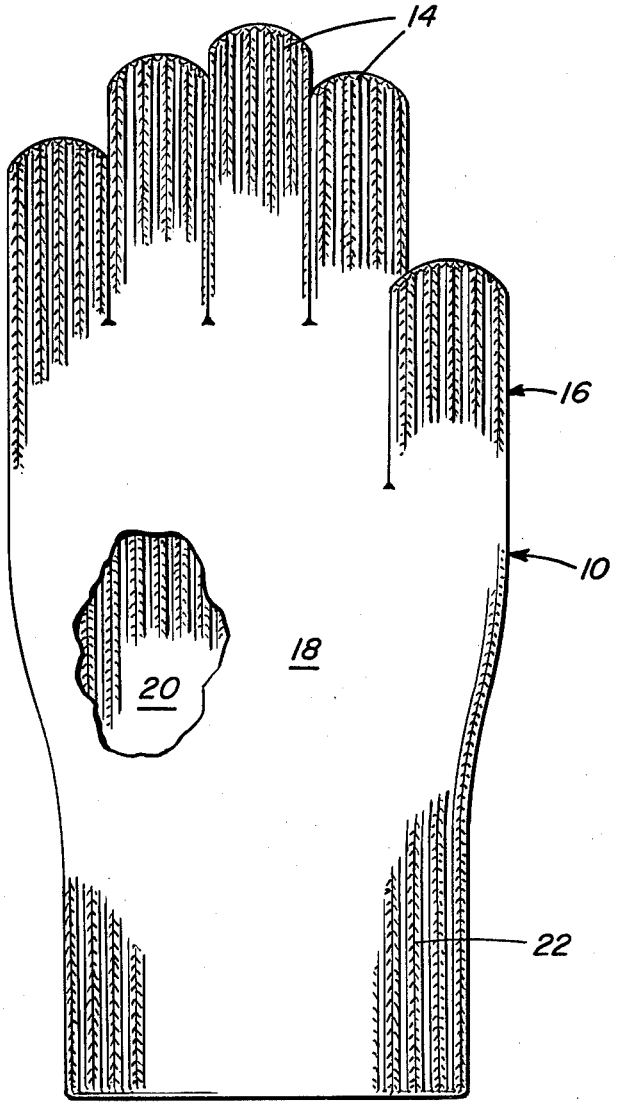
FIG. 1 is a plan view of a protective glove constructed of the yarn having a flexible core.
Figure 2:
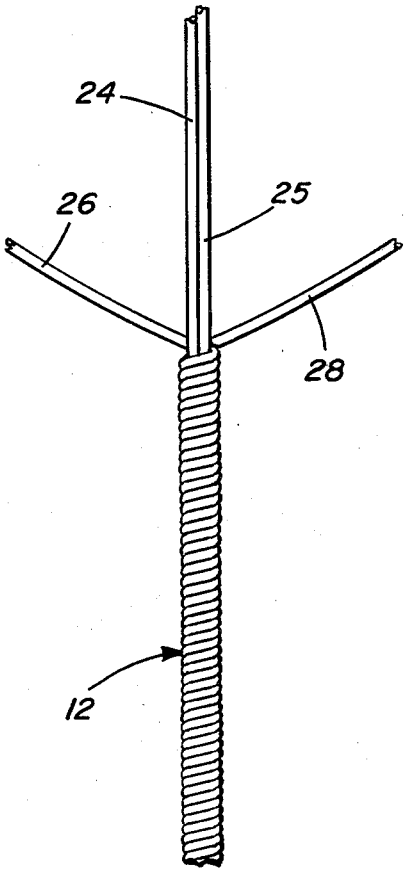
FIG. 2 is an elevational view, on an enlarged scale, illustrating the structure of the yarn and the manner in which the cover fibers are wound on the flexible core.

The drawings illustrate a finished protective glove 10 which is exemplary of a garment or the like constructed from the yarn 12 in which conventional techniques and glove making machinery are employed to form a glove having the usual finger stalls 14, thumb stall 16, front panel 18, rear panel 20 and wrist cuff 22.

The yarn 12 is constructed of a flexible metallic, annealed wire 24 and a strand 25 of flexible aramid fiber, such as a spun strand or filament strand, which form a core. The core is wrapped spirally with two strands 26 and 28 of an aramid fiber, such as "Kevlar", in which one strand is wrapped clockwise around the core and the other strand is wrapped counter-clockwise around the core. The aramid fiber filament core strand 25 may have a denier ranging from 200 to 1500 with the preferred denier range being from 200 to 400 with the aramid fiber strands being in the form of a monofilament and substantially free of twist. When a spun aramid fiber core strand 25 is used, it may have a cotton count ranging from 1 to 60 with the preferred range being 15 to 35 and an ideal cotton count of 25. The core wire 24 is in the form of a flexible wire such as stainless steel, malleable iron, copper, aluminum or other flexible, malleable, totally annealed metallic wire having a diameter ranging between 0.004" and 0.006" plus or minus 0.0005" with no minimum and a maximum of 0.01". The cover strands 26 and 28 may be either spun aramid fiber strands or filament aramid fiber strands, with the filament having denier ranging from 200 to 1500 with the preferred denier being 200 to 400, and with the spun strands having a cotton count from 1 to 60 with the preferred range from 15 to 35 and the ideal being 25. However, it is presently preferred to use spun aramid fiber strands for cover strands 26 and 28.

The yarn 12 may be used with standard needles such as employed in glove knitting machines and may be used with various types of standard machines employed in forming fabrics such as by weaving, knitting or the like. Also, the yarn may be employed for various purposes where long lasting and high strength characteristics as well as high cut resistance is desired. It has been found that fabric formed by yarn of the instant invention exhibits in certain applications a far superior cut resistance and point penetration resistance than similar material made from aramid fiber, such as "Kevlar", alone.

The dimensional characteristics of the core strands of the present invention may vary depending upon the ultimate use of the yarn. The above dimensions have been found critical when forming protective gloves especially adapted for use by persons gripping or handling items having sharp edges or pointed ends or using sharp or pointed items in various work procedures. For example, the gloves may be employed in meat processing plants where sharp knives are used, in glass manufacturing operations where sheet glass or the like is handled, in sheet metal making or forming operations where edges of sheet metal are handled and in many other uses where high cut resistance is desired. The yarn may be employed for various other items wherever natural, synthetic or metallic yarn is presently used with the properties of the core and the aramid fiber covering cooperating to produce a yarn having extremely high tensile strength and resistance to cutting when formed into a fabric or the like but yet the yarn can be utilized in standard machines which handle various natural, synethetic or metallic fibers. The aramid fiber covering facilitates movement of the yarn when making various items and provides substantial additional strength. When a small weave fabric is made, more resistance to penetration of a knife point is provided. The core strand of aramid fiber cushions the yarn and increases the flexibility thereof.

The advantages of this glove over a conventional wire mesh or wire ring glove include its increased strength, resistance to breakage, resistance to absorption of moisture, lack of skin irritation, lightweight characteristics, flexibility, cleanability and insulation characteristics. The glove is safer as it will slip off the hand if caught on some moving machine while the mesh glove cannot since it is buckled in place. The elasticity of the glove enables better fit and the flexibility provides better fuel and more secure gripping of workpieces, tools and the like. The glove is more comfortable and is used on either hand whereas metal mesh gloves are either left or right handed. The glove provides insulation against both cold and heat, has a significant weight advantage, weighing about 2 oz., compared to about 12 to 14 oz. for a metal mesh glove. The glove also can be sterilized when used in food handling and can be readily constructed on existing machines while the metal link glove is usually hand formed from link sheets.

The advantages over the glove disclosed in U.S. Pat. No. 3,883,898 include better machine handling of the yarn, increased resistance to point penetration since the knitted or woven stitch does not elongate as much when stressed, and improved cut resistance by preventing excessive stress of the aramid fibers over the knuckles when a fist is formed.

In heavy duty uses, such as in cables or the like, where multiple yarn strands of the instant invention may be employed, the aramid core strand 25 may be omitted and a single wire core 24 having a diameter up to 0.01" may be used.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A protective glove adapted to be worn by a wearer engaged in activities in which contact between a hand and a sharp edge or surface can occur, said glove being constructed of yarn including a core and a covering wrapped thereon, said covering being of aramid fiber, said core including at least one strand of flexible annealed wire having a diameter up to a maximum of 0.01".

2. The glove as defined in claim 1 wherein said core also includes at least one strand of aramid fiber alongside the wire.

3. The glove as defined in claim 1 wherein the aramid fiber covering includes two strands of aramid fiber wrapped around and completely encasing the core, all of said aramid fiber strands being spun or filament aramid fiber with the filament fiber having a denier range between 200 and 1500 and the spun fiber having a cotton count between 1 and 60.

4. A yarn for use in making high strength items comprising a flexible core, a pair of wrapping strands of aramid fiber wound on the exterior of said core, one of said strands being wound in a clockwise direction and the other of the strands being wound in a counterclockwise direction, said core being constructed of flexible annealed wire and having a diameter up to a maximum of 0.1", said wrapping strands completely encasing said core whereby the yarn may pass through standard fabric yarn handling and processing machinery to form various products, said wire being stainless steel having a diameter ranging between 0.004" to 0.006" plus or minus 0.0005 ", said core including an aramid fiber strand alongside of the wire strand.

5. A yarn for use in making high strength items comprising a flexible core, a pair of wrapping strands of aramid fiber wound on the exterior of said core, one of said strands being wound in a clockwise direction and the other of the strands being wound in a counterclockwise direction, said core being constructed of flexible annealed wire and having a diameter up to a maximum of 0.01", said wrapping strands completely encasing said core whereby the yarn may pass through standard fabric yarn handling and processing machinery to form various products, said core including an aramid fiber strand alongside of the wire strand.

6. The structure as defined in claim 5 wherein said aramid fiber strand in the core is a filament strand having a denier size ranging from 200 to 1500.

7. The structure as defined in claim 6 wherein said aramid strand in the core is a filament having a denier size ranging from 200 to 400.

8. The structure as defined in claim 5 wherein said aramid fiber strand in the core is spun and has a cotton count between 1 and 60.

9. The structure as defined in claim 8 wherein said cotton count is between 15 and 35.

10. The structure as defined in claim 9 wherein said cotton count is 25.

11. The protective glove as defined in claim 1 wherein said wire is stainless steel having a diameter ranging between 0.004" to 0.006" plus or minus 0.0005".

12. The protective glove as defined in claim 11 wherein said core also includes a strand of aramid fiber extending alongside of and in contact with the wire, the aramid fiber core strand being a spun aramid fiber having a cotton count from 1 to 60, said covering including two strands of aramid fiber wrapped in opposite directions and completely encasing the core, the covering strands of aramid fiber being spun aramid fiber having a cotton count between 1 and 60.

13. The protective glove as defined in claim 11 wherein said core also includes a strand of aramid fiber extending alongside of and in contact with the wire, the aramid fiber core strand being a filament aramid fiber having a denier range between 200 and 1500, said covering including two strands of aramid fiber wrapped in opposite directions and completely encasing the core, the covering strands of aramid fiber being filament aramid fiber having a denier range between 200 and 1500.

14. A protective glove constructed of yarn including a core and a synthetic covering thereon, said core including at least one strand of flexible annealed wire having a diameter up to a maximum of 0.0065", said core also including at least one strand of aramid fiber alongside the wire.

15. A protective glove constructed of yarn including a core and a synthetic covering thereon, said core including at least one strand of flexible annealed wire having a diameter up to a maximum of 0.0065", the covering including at least two strands of aramid fiber wrapped around and completely encasing the core, all of said aramid fiber strands being spun or filament aramid fiber with the filament fiber having a denier range between 200 and 1500 and the spun fiber having a cotton count between 1 and 60.

16. The protective glove as defined in claim 14 wherein said wire is stainless steel having a diameter ranging between 0.004" to 0.006" plus or minus 0.0005".

17. A protective glove constructed of yarn including a core and a synthetic covering thereon, said core including at least one strand of flexible annealed wire having a diameter up to a maximum of 0.0065", said core also including a strand of aramid fiber extending alongside the wire, the aramid fiber core strand being a spun aramid fiber having a cotton count from 1 to 60, said covering including two strands of aramid fiber wrapped in opposite directions and completely encasing the core, the covering strands of aramid fiber being spun aramid fiber having a cotton count between 1 and 60.

18. A protective glove constructed of yarn including a core and a synthetic covering thereon, said core including at least one strand of flexible annealed wire having a diameter up to a maximum of 0.0065", said core also including a strand of aramid fiber extending alongside of the wire, the aramid fiber core strand being a filament aramid fiber having a denier range between 200 and 1500, said covering including two strands of aramid fiber wrapped in opposite directions and completely encasing the core, the covering strands of aramid fiber being filament aramid fiber having a denier range between 200 and 1500.

19. A protective glove constructed of yarn comprising a core of stainless steel wire having a diameter ranging between 0.004" to 0.006" plus or minus 0.0005" and a synthetic fiber covering wrapped thereon, said core including at least one aramid fiber strand alongside of the wire strand.

20. The glove as defined in claim 19 wherein said covering includes at least one strand of aramid fiber.

21. A protective glove constructed of yarn comprising a core of stainless steel wire having a diameter ranging between 0.004" to 0.006" plus or minus 0.0005" and a synthetic fiber covering wrapped thereon, the covering including at least two strands of aramid fiber wrapped around and completely encasing the core, all of said aramid fiber strands being spun or filament aramid fiber with the filament fiber having a denier range between 200 and 1500 and the spun fiber having a cotton count between 1 and 60.

22. The glove as defined in claim 21 wherein said cotton count is between 15 and 35.

23. The glove as defined in claim 21 wherein said denier range is between 200 and 400.

24. A yarn for use in making high strength items comprising a flexible annealed wire core having a diameter up to a maximum of 0.0065" and one or more strands of synthetic fiber wrapped around and completely encasing said core whereby the yarn may pass through standard fabric yarn handling and processing machinery to form various products, said core including an aramid fiber strand alongside the wire strand.

25. The yarn as defined in claim 24 wherein at least one of said synthetic fiber wrapping strands is formed of an aramid fiber.

26. The yarn as defined in claim 24 wherein said wire is stainless steel having a diameter ranging between 0.004" to 0.006" plus or minus 0.0005".

27. The yarn as defined in claim 24 wherein said wire core has a diameter up to a maximum of 0.01".

28. The yarn as defined in claim 24 wherein, the aramid fiber core strand is a spun aramid fiber having a cotton count from 1 to 60, said wrapping strands including two strands of aramid fiber wrapped in opposite directions and completely encasing the core, the covering strands of aramid fiber being spun aramid fiber having a cotton count between 1 and 60.

29. The yarn as defined in claim 24 wherein aramid fiber core strand is a filament aramid fiber having a denier range between 200 and 1500, said wrapping strands including two strands of aramid fiber wrapped in opposite directions and completely encasing the core, the covering strands of aramid fiber being filament aramid fiber having a denier range between 200 and 1500.

30. A protective glove comprising knitted yarn which includes:

(a) a core including at least one strand of flexible resilient material having a diameter up to a maximum of 0.01" capable of functioning generally in the manner of a strand of annealed wire having a diameter between about 0.004" and 0.01"; and (b) at least two wrapping strands wound on and completely encasing the exterior of said core, at least one of said wrapping strands being an aramid fiber.

31. The protective glove as defined in claim 30 wherein said core is stainless steel having a diameter ranging between 0.004" to 0.006" plus or minus 0.0005".

* * * * *